US009977360B2

(12) United States Patent
Anthony et al.

(10) Patent No.: US 9,977,360 B2
(45) Date of Patent: May 22, 2018

(54) INNER RESISTIVE FILM WITH DUCTILE PARTICLES AND OUTER RESISTIVE FILM WITHOUT DUCTILE PARTICLES

(71) Applicant: Hewlett-Packard Development Company, L.P., Houston, TX (US)

(72) Inventors: Thomas Anthony, Palo Alto, CA (US); Seongsik Chang, Palo Alto, CA (US); Omer Gila, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/500,911

(22) PCT Filed: Jul. 31, 2014

(86) PCT No.: PCT/US2014/049186

§ 371 (c)(1),
(2) Date: Jan. 31, 2017

(87) PCT Pub. No.: WO2016/018379

PCT Pub. Date: Feb. 4, 2016

(65) Prior Publication Data

US 2017/0219949 A1 Aug. 3, 2017

(51) Int. Cl.

| | |
|---|---|
| ***G03G 15/02*** | (2006.01) |
| ***B41F 31/26*** | (2006.01) |
| ***G03G 15/08*** | (2006.01) |

(52) U.S. Cl.

CPC ..... *G03G 15/0233* (2013.01); *B41F 31/26* (2013.01); *G03G 15/0216* (2013.01); *G03G 15/0258* (2013.01); *G03G 15/0808* (2013.01); *G03G 15/0817* (2013.01); *G03G 15/0818* (2013.01)

(58) Field of Classification Search

CPC ..... G03G 15/02

See application file for complete search history.

(56) References Cited

U.S. PATENT DOCUMENTS

| | | | | |
|---|---|---|---|---|
| 5,089,851 | A * | 2/1992 | Tanaka | G03G 15/0233 361/225 |
| 5,473,418 | A | 12/1995 | Kazakos et al. | |
| 5,600,414 | A | 2/1997 | Hyllberg | |
| 6,069,346 | A | 5/2000 | Hyllberg | |
| 6,374,071 | B1 * | 4/2002 | Sato | G03G 15/0216 361/225 |
| 6,398,702 | B1 | 6/2002 | Schlafer et al. | |

(Continued)

FOREIGN PATENT DOCUMENTS

WO WO-2014062153 A1 4/2014

OTHER PUBLICATIONS

Fauchais, P., "Thermal Sprayed Coatings Used Against Corrosion and Corrosive Wear", Advanced Plasma Spray Applications, www.intechopen.com, Mar. 21, 2012, 37 pp.*

(Continued)

*Primary Examiner* — Clayton E Laballe
*Assistant Examiner* — Jas Sanghera
(74) *Attorney, Agent, or Firm* — Michael A. Dryja

(57) ABSTRACT

An inner resistive film is applied to a conductive substrate. Ductile particles are disposed substantially uniformly throughout the inner resistive film. An outer resistive film is applied to the inner resistive film.

20 Claims, 4 Drawing Sheets

(56) References Cited

U.S. PATENT DOCUMENTS

| | | | | |
|---|---|---|---|---|
| 6,560,432 | B1 | 5/2003 | Longhenry et al. | |
| 7,016,631 | B2 | 3/2006 | Schlafer et al. | |
| 7,366,448 | B2 | 4/2008 | Taniguchi et al. | |
| 8,322,839 | B2 | 12/2012 | Ohshima et al. | |
| 2004/0029692 | A1 | 2/2004 | Blair et al. | |
| 2004/0152575 | A1* | 8/2004 | Kaji | G03G 15/0233 492/56 |
| 2008/0075505 | A1 | 3/2008 | Nagamori et al. | |
| 2010/0247149 | A1 | 9/2010 | Hoshio | |
| 2011/0201485 | A1 | 8/2011 | Gilmartin et al. | |
| 2013/0149001 | A1 | 6/2013 | Miyake et al. | |
| 2013/0259551 | A1 | 10/2013 | Liu et al. | |

OTHER PUBLICATIONS

Plasma Coatings—Non and Conductive Coatings webpage, Oct. 13, 2009, <http://catalog.plasmacoatings.com/item/all-categories/non-and-conductive-coatings/item-1006?&plpver=10>, 2 pp.*

* cited by examiner

INNER RESISTIVE FILM WITH DUCTILE PARTICLES AND OUTER RESISTIVE FILM WITHOUT DUCTILE PARTICLES

BACKGROUND

Electrophotographic printing devices, such as laser printing devices, form images on media like paper. In general, a photoconductive cylinder is charged over its entire surface, and then selectively discharged in accordance with the image to be formed. Charged colorant such as toner adheres to locations on the cylinder that have been discharged, and the toner is then directly or indirectly transferred from the cylinder to the media.

DETAILED DESCRIPTION

Figure 1:
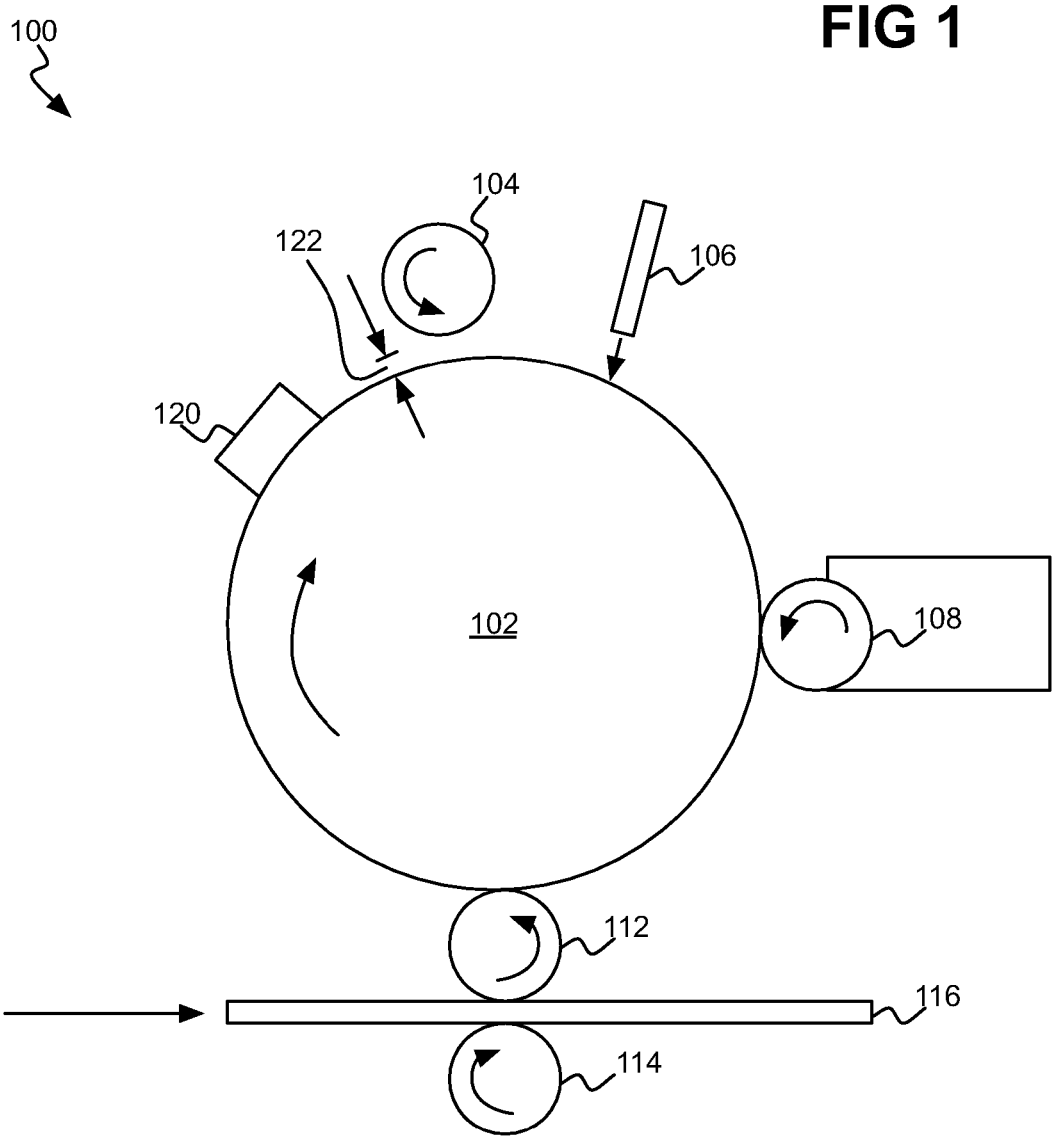
FIG. 1 is a diagram of an example electrophotographic printing device.

As noted in the background section, in electrophotographic printing devices, a photoconductive surface is charged prior to being selectively discharged with an image to be formed on media. Printing devices employ either a charge roller or a corona wire to charge the photoconductive cylinder. The charge roller has a cylindrical conductive substrate to transfer a charge to the entire surface of the photoconductive cylinder.

In some electrophotographic printing devices, the charge roller is in direct physical contact with the photoconductive cylinder while charging, and has an outermost material made of a compliant, conductive rubber so as not to physically damage the photoconductive cylinder. In other electrophotographic printing devices, the outermost material of the charge roller is a hard ceramic. As such the charge roller is usually positioned with a physical air gap between the photoconductive cylinder and the charge roller to minimize potential damage to the photoconductive cylinder.

There are at least two issues involved with the charge roller's functionality of charging the photoconductive cylinder in such a way that ensures optimal print quality of the formed images on media. First, during charging of the photoconductive surface by the charge roller, high intensity discharges, which are referred to as streamers, can occur. Such high intensity discharge events can negatively affect print quality, because the photoconductive surface may not be uniformly charged.

Second, there is an optimal window of the physical gap between the charge roller and the photoconductive cylinder. If the roller-cylinder gap is less than the minimum gap specified by the window, the charge roller may contact the photoconductive cylinder if the machining tolerances of printing device components that affect the gap exceed the minimum gap. If the gap is greater than the maximum gap specified by the window, print quality is impaired.

As to the former issue, it has been found that the intensity of the streamers can be decreased by coating the metal charge roller core with a resistive film. As such, high intensity discharge events are reduced. Specifically, the intensity of the streamers is a function of the thickness of the film applied to the conductive surface, as well as electrical properties of the film.

As to the latter issue, it has been found that coating the metal charge roller core with a resistive material likewise increases the size of the optimal window of the physical roller-cylinder gap in which print quality remains high. Specifically, the maximum gap of the window is increased as the thickness of the resistive coating is increased. This is advantageous, because manufacturing tolerances and other challenges can make it difficult to precisely position the charge roller vis-à-vis the photoconductive cylinder within the confines of a small gap window.

For many types of electrophotographic printing devices, charge rollers are disposable components built into toner cartridges that are periodically replaced, or are otherwise considered periodically replaced consumable items. These types of charge rollers generally have a rubber coating as their resistive film. The rubber coating degrades relatively quickly over time, but the charge roller is regularly replaced when the toner of the toner cartridge of which the charge roller is a part is depleted and a new toner cartridge inserted into the printing device, or when separate replacement is performed to maintain print quality.

However, for commercial production environments, charge rollers are not built into toner cartridges, and further are not considered disposable components that are to be frequently replaced. This is at least because in many such production environments, the electrophotographic printing devices are treated as digital printing presses and run nearly constantly, such that downtime is undesirable. Therefore, it is desirable for the charge rollers to be considered nearly permanent components that are not normally replaced, or at most are infrequently replaced, within the printing devices.

In such electrophotographic printing devices, rubber-coated charge rollers are disadvantageous due to the impermanence of their rubber coatings. A more permanent resistive film is desirably employed, such as ceramic materials like various metal oxides, nitrides, and carbides. A noted shortcoming of such so-called permanent resistive ceramic films is that they are difficult to apply with great thickness. Above about 500 microns, the brittle ceramic films tend to crack during application to the charge roller's metal core and further may delaminate from the substrate.

A resistive coating of 500 microns or less in thickness does not result in optimal print quality, unfortunately, because high intensity discharge events are not minimized as much as desired. Furthermore, a charge roller having a resistive film 500 microns or less results in a relatively small roller-cylinder gap window in which print quality remains high. This small window can be difficult to achieve in electrophotographic printing devices without undue expense and redesign of the printing devices.

In the patent application entitled "resistive film with ductile particles, " filed on Jan. 31, 2017, and assigned U.S. application Ser. No. 15/500,907, techniques are presented to alleviate these shortcomings associated with permanent charge rollers. A charge roller for an electrophotographic printing device includes a cylindrical conductive substrate and a resistive film applied thereto to reduce high intensity discharge events. Ductile particles are disposed substantially uniformly throughout the resistive film to reduce the film's brittleness, thus reducing the likelihood of cracking and delamination, even for films greater than 500 microns in thickness. Extending film thickness beyond 500 microns increases the roller-cylinder gap window in which print quality remains high and improves print quality at operating conditions relative to a thinner film by a further reduction in high intensity discharge events.

However, it has been found that in implementations in which the ductile particles are conductive, such as metal, the ductile particles at the surface of the resistive film may in some situations themselves cause high intensity discharge events. Particularly, when the charge roller is subjected to high voltage, free electrons resident in the conductive particles may respond to an air Paschen discharge, enhancing the resulting electric field, and further accelerating Paschen discharge. This cycle between air discharge and field enhancement proceeds through a positive feedback cycle, and eventually can potentially cause high intensity discharge events that can affect print quality.

Disclosed herein are techniques to alleviate high intensity discharge events resulting from the inclusion of conductive ductile particles within a resistive film-coated charge roller. A charge roller for an electrophotographic printing device includes a cylindrical conductive substrate and two resistive films. An inner resistive film is applied to the substrate to reduce high intensity discharge events, primarily by recessing highly conductive substrate from the discharge region, and includes conductive ductile particles disposed substantially uniformly therein to reduce brittleness. An outer resistive film applied to the inner resistive film does not have conductive particles therein, to further reduce high intensity discharge events, primarily those resulting from the conductive ductile particles at or near the surface of the inner resistive film.

The outer resistive film thus buries the reservoirs of electrons within the conductive ductile particles at the surface of the inner resistive film, minimizing the effect that such electrons can have during charging. The resulting electric field is also reduced, for at least three reasons. First, the distance between the conductive substrate of the charge roller and the photoconductive cylinder is increased due to the additional thickness of the outer resistive film. Second, the distance between the reservoirs of electrons within the conductive particles in the inner resistive film and the photoconductive cylinder is increased. Third, thin, high curvature metal features that may be present in the conductive ductile particles are further distanced from the photoconductive cylinder.

FIG. 1 shows an example electrophotographic printing device 100. Cylindrical components, such as rollers, of the device 100 rotate in the directions indicated by their arrows. A photoconductive cylinder 102, which may also be referred to as a drum, rotates to receive a charge transferred by a rotating charge roller 104 across its photoconductive surface. The photoconductive cylinder 102 and the charge roller 104 are separated by a gap 122 that is within an optimal gap window in which print quality remains high.

An optical discharge mechanism 106, such as a laser, selectively discharges the photoconductive cylinder 102 in accordance with an image to be formed onto media 116, such as paper, as the cylinder 102 continues to rotate. At least one rotating dispensing roller 108 transfers toner to the photoconductive cylinder 102 as the cylinder 102 continues to rotate. The toner is deposited onto the photoconductive cylinder 102 typically just where the cylinder 102 has been discharged, and thus in accordance with the image to be formed.

As the photoconductive cylinder 102 continues to rotate with the selectively transferred toner thereon, a rotating transfer roller 112 transfers the toner from the cylinder 102 onto the media 116 that is advancing from left to right between the transfer roller 112 and a rotating impression roller 114. The photoconductive cylinder 102 rotates past a cleaning mechanism 120 to completely discharge its photoconductive surface and remove any remaining toner still thereon before repeating the described process via being charged by the charge roller 104.

Figure 2:
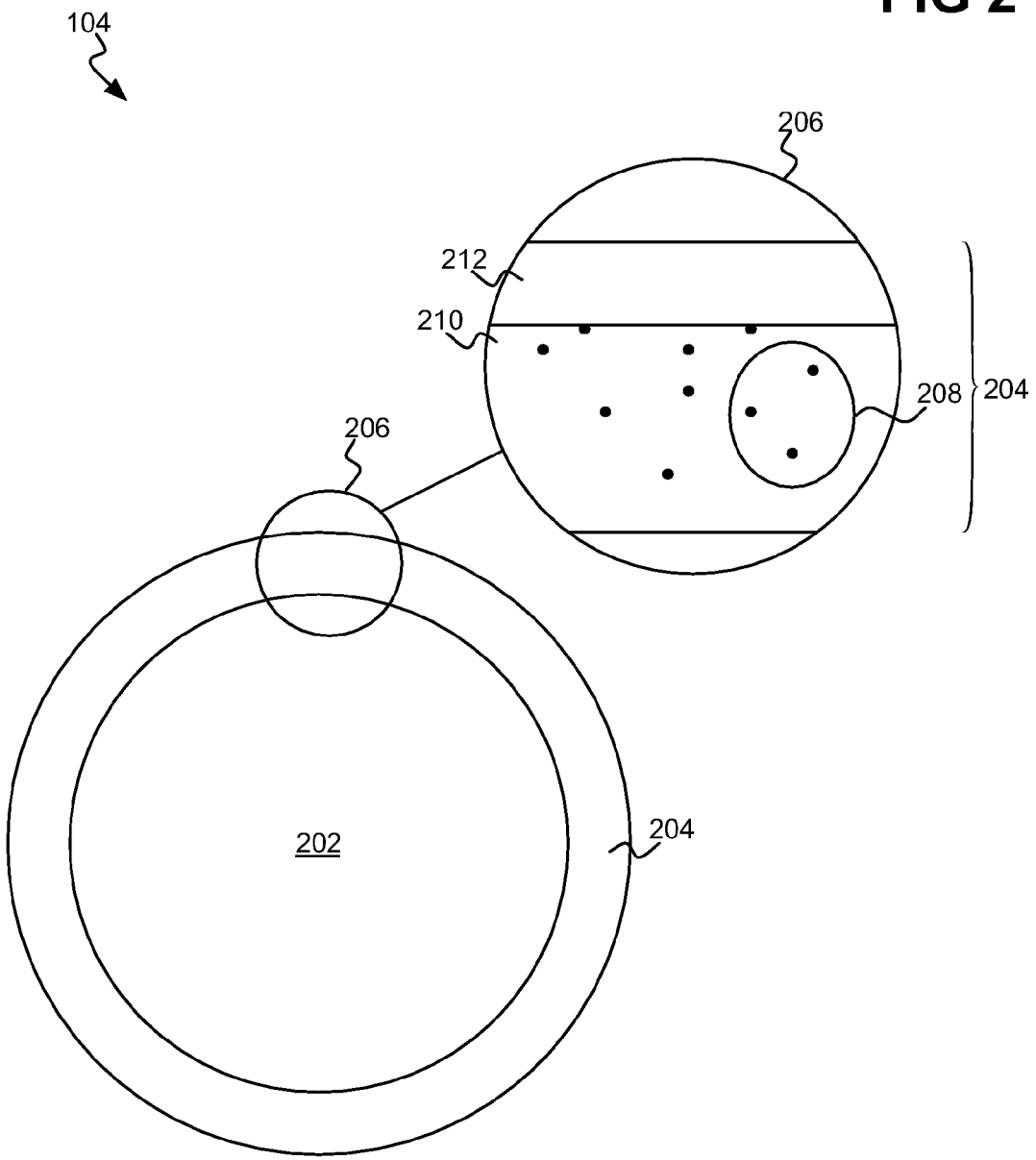
FIG. 2 is a diagram of an example charge roller for an electrophotographic printing device.

FIG. 2 shows an example of the charge roller 104 in more detail. The charge roller 104 has a cylindrical conductive substrate 202, which may be steel. The conductive substrate 202 receives a charge to transfer to the photoconductive surface of the photoconductive cylinder 102 of the electrophotographic printing device 100. The charge roller 104 further includes a resistive film 204 or coating, such as a ceramic film or coating, applied thereto to reduce high intensity discharge events while the photoconductive surface of the printing device 100 is being charged.

A portion 206 of the resistive film 204 of the charge roller 104 is shown in magnified fashion in FIG. 2. Specifically, the resistive film 204 is made up of an inner resistive film 210 and an outer resistive film 212. One or more of the resistive films 210 and 212 may be a ceramic material, such as alumina-titania ($Al_2O_3$-$TiO_2$). That is, the resistive films 210 and 212 may be the same or different material. The inner resistive film 210 includes conductive ductile particles 208 disposed substantially uniformly therethrough. By comparison, the outer resistive film 212 does not include any conductive particles.

The conductive ductile particles 208 disposed substantially uniformly throughout the inner resistive film 210 to reduce brittleness of the overall resistive film 204, reduce potential for delamination of the film 204 from the conductive substrate 202 during application, and permit the thickness of the film 204 to be increased without cracking of the film 204. The dispersal of the ductile particles 208 throughout the inner resistive film 210 further increases the maximum operating gap 122 between the photoconductive cylinder 102 and the charge roller 104 while maintaining or ensuring print quality.

In one implementation, the conductive ductile particles 208 are a metal or metal alloy, such as a nickel aluminum (NiAl) alloy. Testing has shown that when such ductile particles 208 are dispersed within a resistive film 210 of $Al_2O_3$-$TiO_2$ at five percent by weight, which is 2.5% by volume, brittleness of the overall film 204 is greatly reduced. Specifically, brittleness of the resistive film 210 is reduced sufficiently to avoid cracking and delamination during application on the conductive substrate 202 at thicknesses up to two millimeters. This represents an increase of more than 300% as compared to an $Al_2O_3$-$TiO_2$ resistive film 210 that does not have such NiAl ductile particles 208 dispersed substantially uniformly therein.

More generally, the conductive ductile particles 208 can be of a particular resistivity, size, and/or density that permits the thickness of the resistive film 204 to be increased to achieve the advantages and benefits associated with such increased thickness. Metals may have a resistivity in the range $5\times10^{-6}$ to $100\times10^{-6}$ Ohm-centimeters. Furthermore, metal silicides and amorphous metal-based alloys, which are in the class of metals, can have higher resistivity than crystalline metals, but with resistivity generally less than $1\times10^{-3}$ Ohm-centimeters; such metal inclusions may affect print quality. Examples of metal silicides include molybdenum silicide ($MoSi_2$), tungsten silicide ($WSi_2$), titanium silicide ($TiSi_2$), magnesium silicide ($Mg_2Si$), chromium silicide ($Cr_3Si$), and NiSi. Examples of amorphous metal-based alloys include cobalt zirconium (CoZr), cobalt zirconium boron (CoZrB), molybdenum tungsten silicon (MoWSi), molybdenum tantalum boron (MoTaB), and cobalt hafnium silicon (CoHfSi).

The diameter of metal particles in the resistive film is desirably less than about ten microns, such as about two microns. Particle geometry depends on the method of film deposition, such as thermal spraying, as is described in detail later in the detailed description. The sizes mentioned herein are for disk diameters of thermally sprayed materials, and sphere diameters may be somewhat lower.

The volume density of ductile particles within the high resistivity coating is desirably below the percolation threshold for creating a continuous string of ductile particles across the thickness of the film, which is a function of particle geometry and orientation within the film. For spherical inclusions, the percolation threshold is usually about 25%, and for randomly oriented oblate ellipsoids with an aspect ratio of ten, the percolation threshold drops to generally 10%. Ductile metal particle concentration in thermally sprayed resistive coatings is desirably between 2% and 10% by volume.

The outer resistive film 212 is applied to and makes contact with the inner resistive film 210 that is applied to and makes contact with the conductive substrate 202. The outer resistive film 212 ensures that there are no conductive particles on the exterior surface of the resistive film 204 as a whole. Any conductive ductile particles 208 that are at the outer surface of the inner resistive film 210 are covered, or buried, with application of the outer resistive film 212.

The outer resistive film 212 serves to reduce high intensity discharge events in two ways during charging. First, along with the inner resistive film 210, the outer resistive film 212 increases a thickness of the resistive film 204 as a whole. Because high intensity discharge event reduction is a function of increasing thickness, adding the outer resistive film 212 to the inner resistive film 210 makes for a thicker overall resistive film 204. In this way, too, the outer resistive film 212 provides for an increase in the maximum operating roller-photoconductive cylinder gap, which is also a function of increasing thickness of the resistive film 204 as a whole. Second, because the presence of the outer resistive film 212 ensures that there are no conductive ductile particles 208 at or near the outer surface of the overall resistive film 204, high intensity discharge events that would otherwise result from such exposed particles 208, or particles 208 proximate to the surface, are reduced.

The outer resistive film 212 provides an additional benefit in that it decouples film surface topography, internal film morphology, and film surface chemistry from the inclusion of ductile conductive particles. Surface topography of a resistive ceramic charge roller coating may be affected by inclusion of the conductive ductile particles 208. For example, the addition of the conductive ductile particles 208 into the inner resistive film 210 may increase the surface roughness thereof by disparate morphologies of ceramic versus metal portions or by the creation of more voids within the film. Rougher films are more likely to damage the photoconductive cylinder by incidental contact; the addition of the outer resistive film 212 ensures a uniform composition at the coating surface, thus mitigating any roughening associated with a mixture of ceramic and metal.

Adding the conductive ductile particles 208 to the inner resistive film 212 results in exposed particles 208 at the surface as well. In some situations, the conductive materials of the particles 208 may be more chemically reactive than the resistive ceramic coating of the inner resistive film 210. As such, the exposed conductive materials of the particles 208 may react with the chemistry of the printing environment, leading to increased contamination of the charge roller or photoconductive cylinder surfaces. Overcoating the inner resistive film 210 with the outer resistive film 212 prevents these potentially detrimental effects.

The thickness of the outer resistive film 212 is sufficiently thin so as not to add undue brittleness to the resistive film 204 as a whole. As such, the thickness of the outer resistive film 212 is desirably thinner than that of the inner resistive film 210. For instance, the thickness of the inner resistive film 210 may be in the range of 400 to 3,000 microns, whereas the thickness of the outer resistive film 212 may be in the range of 100 to 600, or even up to 1,000, microns.

In one example implementation, the inner resistive film 210 is an Al2O3-TiO2 23% alloy with a thickness of 1,500 microns, and the outer resistive film 212 is a Al2O3-TiO2 26% alloy with a thickness of 300 microns, which does not cause any meaningful brittleness to the overall resistive film 204. In this implementation, the conductive ductile particles 208 within the inner resistive film 210 can be NiAl, where the outer resistive film 212 does not have any conductive particles. It has been found that print quality with this implementation is improved, due to the reduction of high intensity discharge events, as compared to a comparably thick resistive film 204 that includes just the inner resistive film 210 with the conductive ductile particles 208 and not the outer resistive film 212 without any conductive particles.

Figure 3:
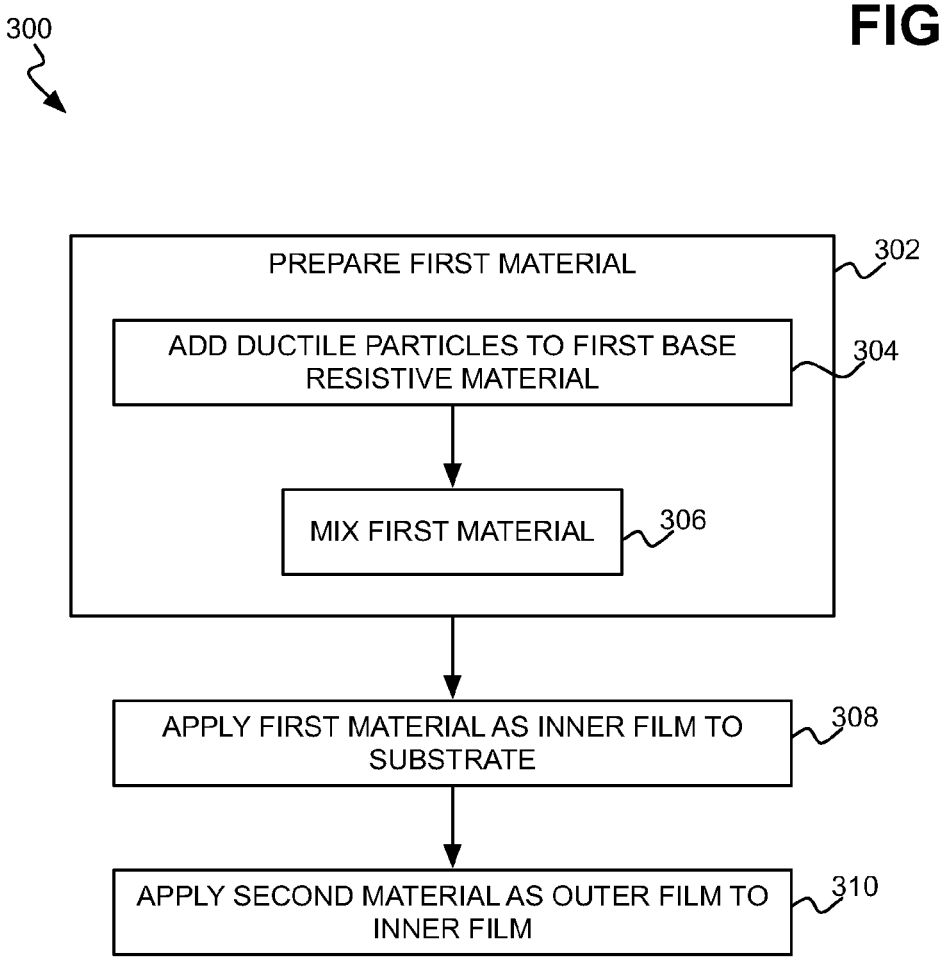
FIG. 3 is a flowchart of an example method for applying a resistive film having at least two layers to a substrate like a charge roller for an electrophotographic printing device.

FIG. 3 shows an example method 300 for forming a resistive film including an inner film having conductive ductile particles dispersed substantially uniformly therein and an outer film without any conductive particles on a substrate. The method 300 can be employed, for instance, to prepare the charge roller 104 that has been described. A first material is prepared that includes a first base resistive material and conductive ductile particles dispersed substantially uniformly therein (302). The first base resistive material may be ceramic particles, such as Al2O3-TiO2, and the conductive ductile particles may be NiAl.

Preparing the first material can include adding the conductive ductile particles to the first base resistive material particles (304), and thoroughly mixing the resulting first material to disperse the ductile particles substantially uniformly throughout the first material (306). Substantially uniformly means that the conductive ductile particles are uniformly distributed throughout the first material as much as possible. Perfect uniformity is unachievable due to randomness, entropy, and so on, but thoroughly mixing the first material after the conductive ductile particles have been introduced for a sufficient length of time results in substantial uniformity.

The resulting first material is applied as an inner film to a substrate at a desired thickness (308), where the conductive ductile particles reduce the brittleness of the film, permitting greater thickness than otherwise would be possible. Application can be performed by thermal spraying of the first material onto the substrate to coat the substrate with the inner film. Thermal spraying includes flame spraying, plasma spraying, arc spraying, and high velocity oxy-fuel deposition techniques. The first material is fed in powder form, in diameters of five-to-fifty micron, into a high temperature flame that melts the particles and propels them towards the substrate, where the molten particles spread into "splats" and are quickly quenched into solid form as disks. Orientation of the disks is parallel to the substrate plane, so the percolation threshold that has been described is higher than for randomly oriented disks. Extreme temperature gradients and cooling rates lead to stresses in thermally sprayed films, which increase in magnitude with film thickness. However, negative effects of such stresses are reduced by the introduction of the ductile particles, as has been described.

A second material that includes a second base resistive material but without any conductive particles dispersed therein is applied as an outer film to the inner film that has been applied to the substrate (310). The second base resistive material—and thus in some implementations the second material as a whole—may be ceramic particles, such as Al2O3-TiO2. Application of the second material can be performed in the same manner as that of the first material, such as by thermal spraying of the second material onto the already applied inner film of the first material on the substrate to coat the inner film with the outer film.

Figure 4:
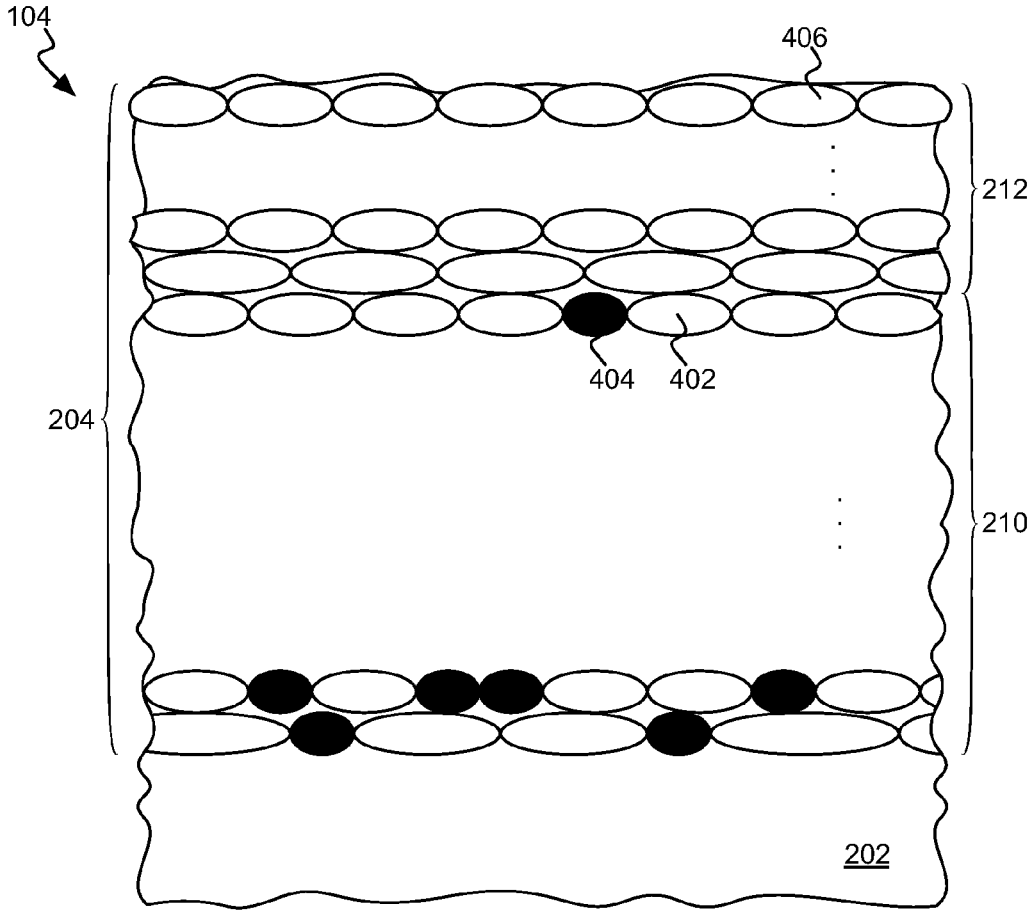
FIG. 4 is a diagram of an example thermally sprayed resistive film on a substrate.

FIG. 4 shows an example of a thermally sprayed resistive film 204 on the conductive substrate 202 of a charge roller 104. The thermally sprayed film 204 is grown on the substrate 202 by successive deposition of particles, those of the inner resistive film 210 and those of the outer resistive film 212. The particles of the inner resistive film 210 include the particles 402 that make up the bulk of the resistive film 210, and the conductive ductile particles 404. The particles of the outer resistive film 212 can include just the particles 406, since the outer resistive film 212 has no conductive particles. The particles 406 of the outer resistive film 212 may be of the same material as the particles 402 of the inner resistive film 210.

It is noted that the film 204 as depicted in FIG. 4 is exaggerated for illustrative clarity. In actuality, the particles may be considered as being more pancake-shaped and randomly stacked, with fewer voids therebetween. Furthermore, the aspect ratio of the particles 402 and 406 that are ceramic is usually between 10:1 and 50:1, whereas the aspect ratio of the ductile particles 404 that are metal is usually between 2:1 and 10:1. It is also noted that more generally, particles can be of variously different and random shapes, in addition to those described herein.

The sizes of the conductive ductile particles that have been referenced above can refer to the diameter of the disks created in the thermal spraying process. The thickness of the disks is generally on the order of one micron, independent of disk diameter. Particles having a diameter of less than five micron are difficult to produce by some processing techniques like thermal spraying. Therefore, the conductive ductile particles may have a diameter of as close to five microns as possible, such as within the range of five to ten microns. Powder source material used in thermal spray systems is typically greater than five microns in diameter.

It is noted that in the implementations that have been described above, the ductile particles within the inner resistive layer or film have been stated as being conductive ductile particles, such as metal such particles.

However, the ductile particles in other implementations may be ductile particles that have higher resistivity than metal, and therefore may not be considered conductive per se. The foregoing description is applicable to such implementations as well. The inclusion of any type of ductile particles may introduce undesirable features, such as increased roughness and voids, as well as greater chemical reactivity. Therefore, having an outer resistive layer or film that encapsulates the ductile particles of the inner resistive layer or film can be beneficial even if the ductile particles are primarily resistive and not highly conductive.

Examples of resistive ductile inclusions include non-stoichiometric metal oxides having a resistivity in the range of $10^{-4}$ to $10^{3}$ Ohm-centimeters. Thus, ductile metallic materials, such as NiAl, may be replaced with a high electrical resistivity material that still has sufficient ductility to afford the advantages associated with inclusion of the ductile particles within the inner resistive film to reduce brittleness. As noted above, most metals have electrical resistivity in the range of $5\times10^{-6}$ to $100\times10^{-6}$ Ohm-centimeters. Electrical resistivity of stoichiometric metal oxides range from about $10^{3}$ to $10^{13}$ Ohm-centimeters, but stoichiometric metal oxides are not usually ductile. However, ductility can be improved by adding metal beyond the stoichiometric composition, although doing so reduces resistivity. Still, the resistivity of non-stoichiometric metal oxides can be many orders of magnitude higher than for metals.

The diameter of resistive ductile particles in the resistive film is desirably within the range of about two to fifty microns. The sizes that have been noted are for disk diameters of thermally sprayed materials, and sphere diameters may be somewhat lower.

The volume density of resistive ductile particles within the high resistivity coating is desirably between 2% and 15% by volume.

Taking the above into account, examples of non-stoichiometric metal oxides that can be employed as the ductile particles include magnesium oxide ($MgO_x$), titanium oxide ($TiO_x$), zirconium oxide ($ZrO_x$), hafnium oxide ($HfO_x$), tantalum oxide ($TaO_x$), chromium oxide ($CrO_x$), cobalt oxide ($CoO_x$), iron oxide ($FeO_x$), copper oxide ($CuO_x$), aluminum oxide ($AlO_x$), and zinc oxide ($ZnO_x$). The resistivity range of such ductile particles 208 is within $10^{-4}$ to $10^{3}$ Ohm-centimeters.

We claim:

1. A charge roller for an electrophotographic printing device, comprising:

a cylindrical conductive substrate adapted to apply a charge to a photoconductive surface of the electrophotographic printing device;

an inner resistive film applied to the cylindrical conductive substrate to reduce high intensity discharge events while the photoconductive surface is being charged, the inner resistive film having disposed substantially uniformly therein a plurality of ductile particles disposed to reduce brittleness of the inner resistive film, wherein the ductile particles have a density within the inner resistive film of two to fifteen percent by volume; and an outer resistive film applied to the inner resistive film to further reduce the high intensity discharge events while the photoconductive surface is being charged.

2. The charge roller of claim 1, wherein disposal of the ductile particles within the inner resistive film and application of the outer resistive film to the inner resistive film provide for a combined thickness of the inner resistive film and the outer resistive film to be increased.

3. The charge roller of claim 1, wherein disposal of the ductile particles within the inner resistive film and application of the outer resistive film to the inner resistive film provide for an increase in a maximum operating gap between an outermost surface of the outer resistive film and the photoconductive surface while ensuring print quality of the electrophotographic printing device to be maintained.

4. The charge roller of claim 1, wherein at least one of:

the ductile particles are conductive ductile particles;

the ductile particles each have a particle size within the range of two-to-ten microns in diameter;

the ductile particles comprise a metal having a resistivity in a range of $5\times10^{-6}$ to $100\times10^{-6}$ Ohm-centimeters;

the ductile particles comprise a nickel aluminum alloy;

the ductile particles are resistive ductile particles;

the ductile particles comprise a material having a resistivity within a range of $10^{-4}$ to $10^{3}$ Ohm-centimeters; and the ductile particles comprise a non-stoichiometric metal oxide having a resistivity in a range of $10^{-4}$ to $10^{3}$ Ohm-centimeters.

5. The charge roller of claim 1, wherein the inner resistive film and the outer resistive film comprise an identical material but for the ductile particles within the inner resistive film.

6. The charge roller of claim 1, wherein at least one of: the outer resistive film comprises a ceramic material; and the outer resistive film comprises alumina-titania.

7. The charge roller of claim 1, wherein the inner resistive film has a thickness within a range of 400 to 3,000 microns.

8. The charge roller of claim 1, wherein the outer resistive film has a thickness within a range of 100 to 1,000 microns.

9. The charge roller of claim 1, wherein the outer resistive film is thinner than the inner resistive film.

10. The charge roller of claim 1, wherein the inner resistive film and the outer resistive film comprise ceramic.

11. An electrophotographic printing device comprising:

a photoconductive surface;

a charge roller to charge the photoconductive surface, the charge roller having an inner ceramic coating having a plurality of ductile particles dispersed substantially uniformly therethrough, and an outer ceramic coating to reduce high intensity discharge events resulting from the ductile particles within the inner ceramic coating; and an optical discharge mechanism to selectively discharge the photoconductive surface in accordance with an image to be formed on media.

12. The charge roller of claim 11, wherein the inner ceramic coating has a thickness within a range of 400 to 3,000 microns.

13. The charge roller of claim 11, wherein the outer ceramic coating has a thickness within a range of 100 to 1,000 microns.

14. The charge roller of claim 11, wherein the outer ceramic coating is thinner than the inner ceramic coating.

15. The charge roller of claim 11, wherein disposal of the ductile particles within the inner ceramic coating and application of the outer ceramic coating to the inner resistive film provide for a combined thickness of the inner ceramic coating and the outer ceramic coating to be increased.

16. The charge roller of claim 11, wherein disposal of the ductile particles within the inner ceramic coating and application of the outer ceramic coating to the inner resistive film provide for an increase in a maximum operating gap between an outermost surface of the outer ceramic coating and the photoconductive surface.

17. A method comprising:

applying a first material including a first base resistive ceramic material and a plurality of ductile particles dispersed substantially uniformly therein as an inner film to a substrate; and applying a second material including a second base resistive ceramic material without any conductive particles dispersed therein as an outer film to the inner film applied to the substrate.

18. The method of claim 17, further comprising:

preparing the first material by adding the ductile particles to the first base resistive material and thoroughly mixing the first material to disperse the ductile particles substantially uniformly therein.

19. The method of claim 17, wherein applying the first material as the inner film to the substrate comprises thermally spraying the first material onto the substrate to coat the substrate with the inner film, and wherein applying the second material as the outer film to the substrate comprises thermally spraying the second material onto the inner film to coat the inner film with the outer film.

20. The method of claim 17, wherein the ductile particles have a density within the inner resistive film of between two to fifteen percent by volume.

* * * * *